US008887493B2

(12) United States Patent
Shin

(10) Patent No.: US 8,887,493 B2
(45) Date of Patent: Nov. 18, 2014

(54) FITTING PORTION STRUCTURE OF DEVICE FOR POST-PROCESSING EXHAUST GAS IN AGRICULTURAL OPERATION VEHICLE

(75) Inventor: Yong Shin, Gyeongsangnam-do (KR)

(73) Assignee: Daedong Industrial Co., Ltd., Daegu (KR)

( * ) Notice: Subject to any disclaimer, the term of this patent is extended or adjusted under 35 U.S.C. 154(b) by 82 days.

(21) Appl. No.: 13/885,524

(22) PCT Filed: Nov. 16, 2011

(86) PCT No.: PCT/KR2011/008771

§ 371 (c)(1),
(2), (4) Date: Jul. 22, 2013

(87) PCT Pub. No.: WO2012/067434

PCT Pub. Date: May 24, 2012

(65) Prior Publication Data

US 2013/0298551 A1 Nov. 14, 2013

(30) Foreign Application Priority Data

Nov. 16, 2010 (KR) ..... 10-2010-0113709

(51) Int. Cl.

| | |
|---|---|
| ***F01N 3/10*** | (2006.01) |
| ***F01N 3/00*** | (2006.01) |
| ***F01N 13/00*** | (2010.01) |
| ***F01N 13/10*** | (2010.01) |
| ***F01N 13/18*** | (2010.01) |

(52) U.S. Cl.

CPC *F01N 3/00* (2013.01); *F01N 13/00* (2013.01); *F01N 13/10* (2013.01); *F01N 13/1805* (2013.01); *F01N 13/1855* (2013.01); *F01N 2450/30* (2013.01); *F01N 2260/20* (2013.01); *F01N 2450/22* (2013.01); *F01N 2450/24* (2013.01)

USPC ..... 60/299; 60/280; 60/295; 60/311; 60/324; 180/89.2; 180/309

(58) Field of Classification Search

USPC ..... 60/272, 280, 295, 297, 299, 300, 311, 60/323, 324; 180/89.2, 309, 900

See application file for complete search history.

(56) References Cited

U.S. PATENT DOCUMENTS

| | | | |
|---|---|---|---|
| 5,934,070 A | 8/1999 | Lagelstorfer | |
| 7,937,936 B2 * | 5/2011 | Recker et al. | 60/297 |

(Continued)

FOREIGN PATENT DOCUMENTS

| | | |
|---|---|---|
| JP | 2004-293495 A | 10/2004 |
| JP | 2009-035111 A | 2/2009 |
| JP | 2010-084541 A | 4/2010 |

OTHER PUBLICATIONS

International Search Report for PCT Application No. PCT/KR2011/008771 which corresponds to the above-identified U.S. application.

*Primary Examiner* — Binh Q Tran
(74) *Attorney, Agent, or Firm* — LRK Patent Law Firm

(57) ABSTRACT

A fitting portion structure of a device for post-processing exhaust gas in an agricultural operation vehicle is provided. The device is arranged in parallel to the lengthwise direction of an engine at the upper portion of an exhaust manifold of the engine, an exhaust gas inlet is coupled to the exhaust manifold or to a turbo charger and a flange pipe which are located at the lower portion of the exhaust gas inlet, and a fixing means is arranged between the engine and the device to support the load of the device. The fixing means includes a frontal bracket arranged between a cylinder head on the front side of the engine and a DPF canning of the device, and a rear bracket arranged between a cylinder head on the rear side of the engine and a flange coupling portion of the flange pipe.

16 Claims, 3 Drawing Sheets

(56) References Cited

U.S. PATENT DOCUMENTS 8,516,807 B2 * 8/2013 Kosaka et al. ..... 60/299
8,596,049 B2 * 12/2013 Isada et al. ..... 60/302
8,739,918 B2 * 6/2014 Mariner et al. ..... 180/309
8,820,468 B2 * 9/2014 Sekiya ..... 180/309
8,821,608 B2 * 9/2014 Mitsuda ..... 55/523

* cited by examiner

FITTING PORTION STRUCTURE OF DEVICE FOR POST-PROCESSING EXHAUST GAS IN AGRICULTURAL OPERATION VEHICLE

TECHNICAL FIELD

The present invention relates to a fitting structure for an exhaust gas post-processing device in an agricultural task vehicle.

BACKGROUND ART

Most of agricultural task vehicles, such as tractor, are supplied with driving power and task power through a diesel engine.

The diesel engine refers to a reciprocal movement type internal combustion engine that is driven by compression and ignition using diesel oil or heavy oil as fuel. The diesel engine is excellent in durability, but it is disadvantageous in that it discharges serious nitrogen oxide ($NO_x$) and particulate matters (PM) that have a catastrophic effect on air pollution as compared with a gasoline engine.

Accordingly, each country is strengthening exhaust gas regulations on a diesel engine and is adopting various measures, such as delaying injection timing technically, reducing a concentration of nitrogen oxide using an exhaust gas recirculation device, and improving the combustion performance of the engine in order to reduce particulate materials.

In particular, post-processing techniques include a oxidation catalyst for purifying high-melting point hydrocarbon in particulate materials (PM), a DeNOx catalyst for decomposing and reducing nitrogen oxide (NOx) in an excess oxygen atmosphere, a diesel particulate material (smoke) filter (DPF) for filtering particulate materials (PM), etc.

From among them, the Diesel Particulate Filter (DPF) is a technique in which particulate materials discharged from a diesel engine are collected by the filter and burnt (recycled) and the recycled particulate materials are collected again and then used. Accordingly, the PDF has been known as an excellent exhaust gas post-processing device in terms of performance because it can reduce smoke by 80% or higher.

However, the DPF (hereinafter collectively called an exhaust gas post-processing device) has many difficulties in being mounted on an existing task vehicle because the DPF is bulky and heavy.

In particular, the exhaust gas post-processing device had a limited problem in that it must be installed in a position closest to the engine because it requires an exhaust gas temperature higher than a specific temperature in order to remove particulate materials certainly through combustion and or obtain sufficient catalyst activity.

Accordingly, the exhaust gas post-processing device is inevitably installed within an engine room, but it was difficult to secure an installation space because an existing engine room structure was narrow.

Furthermore, most of agricultural task vehicles generate severe traveling vibration because a high horsepower engine is mounted on the agricultural task vehicle. If fixing means for firmly supporting the exhaust gas post-processing device is not provided in the agricultural task vehicle, the exhaust gas post-processing device can be broken by a vibration impact or the purification function of the exhaust gas post-processing device can be damaged. In serious cases, the exhaust gas post-processing device departs from a fixed position during driving and collides against a peripheral structure, in particular, the engine, thereby being capable of generating a serious failure and accident.

DISCLOSURE

Technical Problem

The present invention has been made to solve the above problems occurring in the prior art, and an object of the present invention is to provide a fitting structure for an exhaust gas post-processing device in an agricultural task vehicle, wherein the exhaust gas post-processing device is disposed in parallel to the length direction of an engine over the exhaust manifold of the engine and an exhaust gas inlet is coupled with the exhaust manifold or a turbo charger disposed under the exhaust gas inlet through a flange pipe so that the distance between the exhaust gas outlet of the engine and the exhaust gas inlet of the exhaust as post-processing device is reduced to the shortest distance.

Another object of the present invention is to provide a fitting structure for an exhaust gas post-processing device in an agricultural task vehicle, which is capable of stably supporting the sag and vibration impact of the exhaust as post-processing device by installing fixing means for supporting the weight of the exhaust as post-processing device between the engine and the exhaust gas post-processing device.

Furthermore, yet another object of the present invention is to provide a fitting structure for en exhaust gas post-processing device in an agricultural task vehicle, which proposes a structure including additional brackets for support without processing an engine casing or changing an existing engine room structure in installing fixing means.

Technical Solution

In accordance with an aspect of the present invention, there may be provided a fitting structure for fitting an exhaust gas post-processing device for purifying an exhaust gas from the engine of an agricultural task vehicle into on engine room in an agricultural task vehicle, wherein the exhaust gas post-processing device is disposed in parallel to the length direction of the engine over the exhaust manifold of the engine, an exhaust gas inlet is coupled with the exhaust manifold or a turbo charger disposed under the exhaust gas inlet through a flange pipe, and fixing means for supporting the weight of the exhaust gas post-processing device is installed between the engine and the exhaust gas post-processing device; and the fixing means includes a front bracket installed between a cylinder head on the front side of the engine and the DPF canning of the exhaust gas post-processing device and a rear bracket installed between the cylinder head on the rear side of the engine and the flange coupling portion of the flange pipe.

Here, exhaust gas post-processing device may be disposed in the upper left part of the engine when a flywheel housing of the engine is seen at the front.

Furthermore, the exhaust gas post-processing device may include the exhaust gas inlet formed in the rear of the engine and a purification gas outlet formed in front of the engine.

Here, the purification as outlet of the exhaust gas post-processing device may be disposed toward the bottom of the engine room.

Furthermore, the flange pipe may be curved in a curved pipe form in which pipes extended in a horizontal direction and a vertical direction are coupled, a flange coupling portion coupled with the exhaust manifold or a turbo charger may be formed at the end of the pipe in the horizontal direction, and another flange coupling portion coupled with the exhaust gas inlet may be formed at the end of the pipe in the vertical direction.

Furthermore, the front bracket may include a first bracket having a lower end coupled with the cylinder head on cue front side of the engine and a second bracket installed between the upper end of the first bracket and the bottom of the DPF canning of the exhaust gas post-processing device in such a way as to support the weight of the exhaust gas post-processing device.

Here, the lower end of the first, bracket may be coupled with the side of the cylinder head and the upper end of the first bracket may be detachably coupled with the second bracket in such a way as to form a bolt coupling portion.

Furthermore, the second bracket may have an upper end coupled with the bottom of the DPF canning of the exhaust gas post-processing device by way of welding and have a lower end detachably coupled with the upper end of the first bracket using the bolt coupling portion.

Meanwhile, in accordance with another embodiment of the front bracket, the first bracket may have the lower end coupled with the side of the cylinder head through a long hole so that the position of the first bracket is adjusted and have the upper end coupled with the second bracket by way of welding or formed integrally with the second bracket.

Here, the planes of the first bracket and the second bracket may be coupled in such a way as to cross each other.

Furthermore, the rear bracket may include a third bracket having a lower end coupled with the cylinder head on the rear side or the engine and having an upper end coupled with the flange coupling portion of the flange pipe coupled with the exhaust gas inlet; and a fourth bracket having a lower end coupled with a flange coupling portion of the exhaust gas inlet coupled with the flange pipe and having an upper end coupled with the bottom of a DOC canning of the exhaust gas post-processing device in such as a way as to support the weight of the exhaust gas post-processing device.

Here, the third bracket may have the lower end extended in a horizontal direction and detachably coupled with the top of the cylinder head using bolts and have the upper end, extended in a vertical direction, coupled with the side of the flange coupling portion of the flange pipe using bolts or welding.

Furthermore, the fourth bracket may have the lower end and the upper end curved and extended in a horizontal direction, have the upper end coupled with the bottom of the DOC canning of the exhaust gas post-processing device by way of welding, and have the lower end coupled with the flange coupling portion of the exhaust gas inlet by way of welding.

Meanwhile, the fixing means may further include a brace disposed between the flange pipe and the exhaust manifold, for supporting the weight of the exhaust gas post-processing device.

Here, the upper end of the brace may be coupled with the bottom of the flange pipe by way of welding or formed integrally with the flange pipe, and the lower end of the brace may be coupled with the top of the exhaust manifold using bolts.

Furthermore, a heat-shielding plate may be interposed between coupling surfaces of the exhaust manifold and the brace.

Advantageous Effects

In the present invention having the above construction, the exhaust as post-processing device is disposed in parallel to the length direction of the engine over the exhaust manifold of the engine and the exhaust gas inlet is coupled with the exhaust manifold or the turbo charger disposed under the exhaust gas inlet through the flange pipe so that the distance between the exhaust gas outlet of the engine and the exhaust gas inlet of the exhaust gas post-processing device is reduced to the shortest distance. Accordingly, there are advantages in that energy efficiency can be improved and the purification performance of the exhaust gas post-processing device can be improved.

Furthermore, in the present invention, the sag and vibration impact of the exhaust gas post-processing device can be stably supported by installing the fixing means for supporting the weight of the exhaust gas post-processing device between the engine and the exhaust gas post-processing device. Accordingly, there is an advantage in that the lifespan and purification performance of the exhaust gas post-processing device can be maintained stably.

Furthermore, the present invention is advantageous in that an influence on the engine can be minimized and an economic effect is achieved by proposing the structure including additional brackets for support without processing an engine casing or changing an existing engine room structure in installing fixing means.

MODE FOR INVENTION

Hereinafter, preferred embodiments or the present invention are described in detail with reference to the accompanying drawings.

Figure 1:
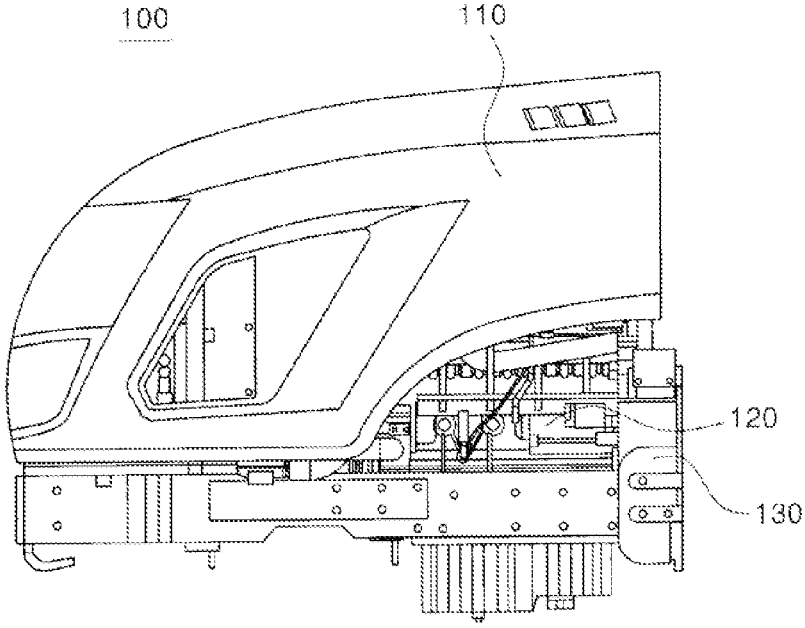
FIG. 1 an outside view showing the engine room of an agricultural task vehicle in accordance with an embodiment of the present invention.

FIG. 1 an outside view showing the engine room or an agricultural task vehicle in accordance with an embodiment of the present invention.

Referring to FIG. 1, there is disclosed the engine room 100 of a tractor. The engine room 100 has a structure in which an internal engine 120 is protected by a bonnet 110 that can be upward opened.

When the engine room 100 is seen in FIG. 1, the left side is the front of the engine 120 and the right side is the rear of the engine 120.

Motive power generated from the engine 120 is delivered to a transmission (not shown) via a flywheel housing 130 on the rear of the engine 120. Here, a radiator device for cooling the engine 120 can be installed using the space of the engine room 100 on the front side of the engine 120.

An internal structure from which the bonnet 110 of the engine room 100 has been removed is described with reference to FIGS. 2 to 5.

Figure 2:
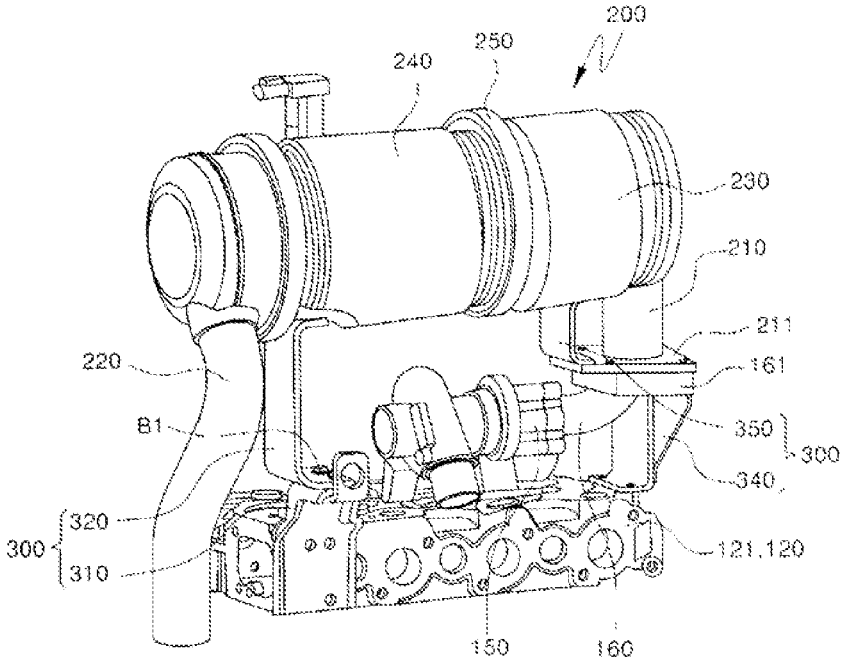
FIG. 2 is a perspective view showing an upper coupling structure of an exhaust gas post-processing device and an engine for an agricultural task vehicle in accordance with the present invention.
Figure 3:
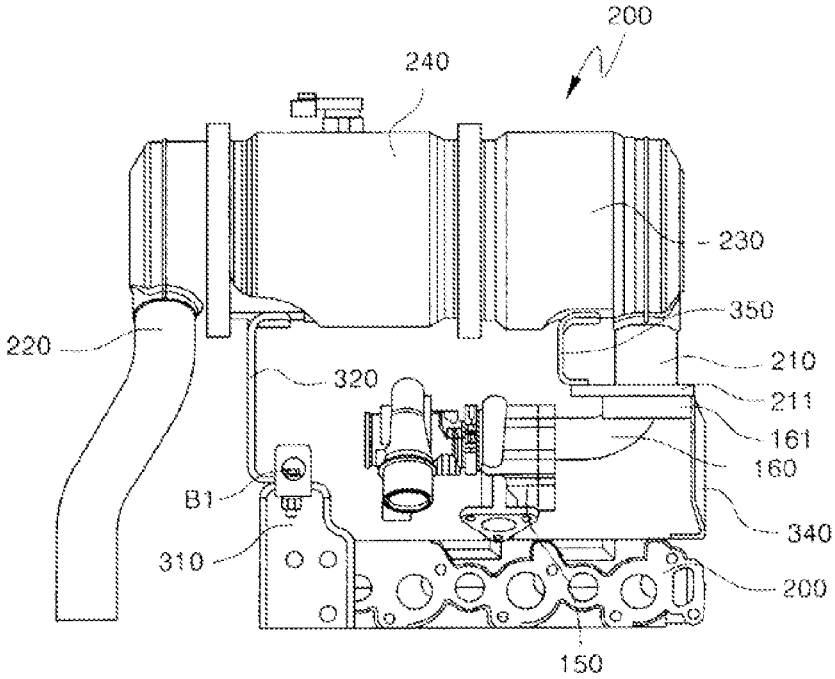
FIG. 3 is a perspective view showing an upper coupling structure of the exhaust gas post-processing device and the engine for an agricultural task vehicle in accordance with the present invention.
Figure 4:
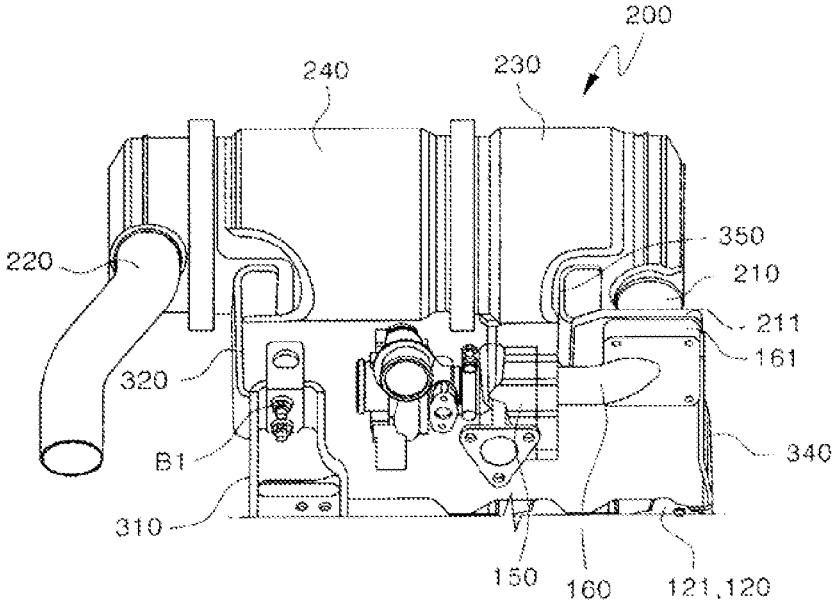
FIG. 4 is a perspective view showing an upper coupling structure of the exhaust gas post-processing device and the engine for an agricultural task vehicle in accordance with the present invention which is seen at the bottom.
Figure 5:
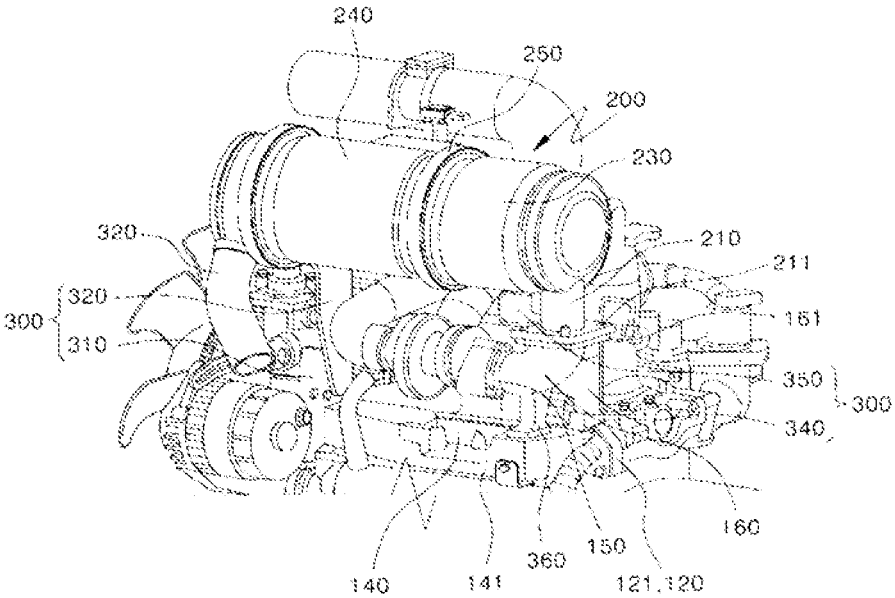
FIG. 5 is a perspective view showing an upper coupling structure of the exhaust gas post-processing device and the engine for the agricultural task vehicle in accordance with another embodiment of the present invention.

FIG. 2 is a perspective view showing an upper coupling structure of an exhaust gas post-processing device and the engine for an agricultural task vehicle in accordance with the present invention, FIG. 3 is a perspective view showing an upper coupling structure of the exhaust gas post-processing device and the engine for an agricultural task vehicle in accordance with the present invention, FIG. 4 is a perspective view showing an upper coupling structure of the exhaust gas post-processing device and the engine for an agricultural task vehicle in accordance with the present invention which is seen at the bottom, and FIG. 5 is a perspective view showing an upper coupling structure of an exhaust gas post-processing device and an engine for an agricultural task vehicle in accordance with another embodiment of the present invention.

Referring to FIGS. 2 to 5, an exhaust gas post processing device 200 for purifying an exhaust gas generated from the engine 120 of a tractor is fitted within the engine room 100 using fixing means 300.

Here, the exhaust gas post-processing device 200 is described. The exhaust gas post-processing device 200 collects particulate materials discharged from a diesel engine using a filter, burns the collected particulate materials, collects the burnt particulate materials again, and continues to use the particulate materials. A noble metal catalyst device is used in order to satisfy exhaust gas emission criteria. The exhaust as post-processing device 200 is directly coupled with an exhaust manifold 140 in the case of a natural intake type and is directly coupled with a turbine, that is the exhaust gas outlet of a turbo charger 150, in the case of a surcharging type.

An external view of the exhaust gas post-processing device 200 is formed of a canning. The canning includes a DOC canning 230 for surrounding and protecting a Diesel Oxidation Catalyst (hereinafter referred to as a 'DOC') and a DPF canning 240 for surrounding and protecting a Diesel Particulate Filter (hereinafter referred to as a 'DPF'). An exhaust gas inlet 210 to be coupled with the exhaust manifold 140 of the engine 120 or the turbo charger 150 can be provided on the DOC canning (230) side, and a purification gas outlet 220 coupled with a muffler pipe (not shown) can be provided on the DPF canning (240) side.

The DOC canning 230 and the DPF canning 240 are coupled by a clamp 250 installed on the circumference of the canning. In particular, when the clamp 250 is slightly loosened and the DOC canning 230 and the DPF canning 240 are minutely rotated, a relative position between pieces of the fixing means 300 to be described later can be adjusted, thereby being capable of correcting an error in the position where the fixing means 300 is mounted on the cylinder head 121 of the engine 120.

Referring back to FIGS. 2 to 5, the exhaust gas post-processing device 200 is disposed in parallel to the length direction of the engine 120 over the exhaust manifold 140 of the engine 120. The exhaust gas inlet 210 is coupled with the exhaust manifold 140 through a flange pipe 160 in the case of a natural intake type, and the exhaust gas inlet 210 is coupled with the turbo charger 150 disposed under the exhaust gas post-processing device 200 through the flange pipe 160 in the case of a surcharging type.

Here, the exhaust gas post-processing device 200 may be disposed in the upper left part of the engine 120 when the flywheel housing 130 is seen at the front.

Furthermore, the exhaust gas inlet 210 of the exhaust gas post-processing device 200 may be formed on the rear side of the engine 120, and the purification gas outlet 220 may be formed on the front side of the engine 120.

Here, the exhaust gas inlet 210 and the purification gas outlet 220 of the exhaust gas post-processing device 200 can be formed toward the bottom of the engine room 100.

Furthermore, the purification gas outlet 220 can be coupled with the muffler pipe extended outside the engine room 100 so that an exhaust gas is discharged into the air through the purification gas outlet 220.

Here, the principle of the turbo charger 150 is described below. The turbo charger means a mechanism for increasing the output by rotating a turbine using the pressure of an exhaust gas essentially generated from the engine 120 and pushing air sucked by the rotary power of the turbine with pressure stronger than atmospheric pressure.

The flange pipe 160 provided to couple the exhaust manifold 140 or the turbo charger 150 and the exhaust gas post-processing device 200 is curved in an 'L'-shaped curved pipe form. A flange coupling portion coupled with the exhaust manifold 140 or the turbo charger 150 can be formed at the end of she pipe in a horizontal direction, and another flange coupling portion coupled with the exhaust gas inlet 210 can be formed at the end or the pipe in a vertical direction.

Furthermore, the fixing means 300 is described in detail with reference to FIGS. 2 to 5. The fixing means 300 includes a first bracket 310, a second bracket 320, a third bracket 340, and a fourth bracket 350 and may further include a brace 360 as shown in FIG. 5.

The first bracket 310 and the second bracket 320 form a front bracket installed between a cylinder head 121 on the front side of the engine 120 and the DPF canning 240 of the exhaust gas post-processing device 200.

Here, the lower end or the first bracket 310 is coupled with the cylinder head 121 on the front side of the engine 120. The lower end of the first bracket 310 can be coupled with the side of the cylinder head 121 and the upper end thereof can be curved in a horizontal direction, thereby being capable of forming a bolt coupling portion B1 with which the second bracket 320 is detachably coupled.

Furthermore, the second bracket 320 is described below. The second bracket 320 is installed between the upper end of the first bracket 310 and the bottom of the DPF canning 240 of the exhaust gas post-processing device 200, thus supporting the weight of the exhaust gas post-processing device 200. The lower end and the upper end of the second bracket 320 are curved and extended in a horizontal direction so that the upper end can be coupled with the bottom of the DPF canning 240 of the exhaust gas post-processing device 200 by way of welding and the lower end can be detachably coupled with the upper and of the first bracket 310 using the bolt coupling portion B1.

Meanwhile, FIG. 5 shows another embodiment of the first bracket 310 and the second bracket 320 that form the front bracket.

In accordance with another embodiment of the front bracket shown in FIG. 5, the first bracket 310 is coupled with the side of the cylinder head 121 through a long hole formed at the lower end thereof so that the position of the first bracket 310 can be adjusted, and the upper end of the first bracket 310 can be coupled with the second bracket 320 by way of welding. If the first bracket 10 and the second bracket 320 are formed collectively as in a case where they are formed by casting, the first bracket 10 and the second bracket 320 can be integrally formed.

Here, the long hole is formed at the lower end of the first bracket 310 in order to adjust the position of the first bracket 310 when the first bracket 310 is coupled with the side of the cylinder head 121, in particular, using bolts.

Furthermore, the first bracket 310 and the second bracket 320 may be coupled so that both planes of the first bracket 310 and the second bracket 320 cross each other, for example, both planes meet each other vertically in order to increase the strength of the entire front bracket.

Furthermore, the first bracket 310 and the second bracket 320 are integrally formed and the upper end of the second bracket 320 is coupled with the bottom of the DPF canning 240 by way of welding, with the result that the front bracket 310 can be fixed to the cylinder head 210 and the engine 120 of the DPF canning 240 can be fitted.

Meanwhile, the third bracket 340 and the fourth bracket 350 form a rear bracket installed between the cylinder head 121 on the rear side of the engine 120 and the DOC canning 230 of the exhaust gas post-processing device 200.

Here, the third bracket 340 is described below. The third bracket 340 is coupled with the lower end of the cylinder head 121 on the rear side of the engine 120, and the upper end of the third bracket 340 is coupled with the flange coupling portion 161 of the flange pipe 160 coupled with the exhaust gas inlet 210. The lower end of the third bracket 340 can be extended in a horizontal direction and coupled with the top of the cylinder head 121 using bolts in such a way as to be detachable, and the upper end of the third bracket 340 extended in a vertical direction can be coupled with the side of the flange coupling portion 161 of the flange pipe 160 using bolts or welding.

Furthermore, the fourth bracket 350 is described below. The lower end of the fourth bracket 350 is coupled with the flange coupling portion 211 of the exhaust gas inlet 210 coupled with the fleece pipe 160, and the upper end thereof is coupled with the bottom of the DOC canning 230 of the exhaust gas post-processing device 200 in order to support the weight of the exhaust gas post-processing device 200. The lower end and the upper end of the fourth bracket 350 are curved and extended in a horizontal direction, so the upper end can be coupled with the bottom of the DOC canning 230 of the exhaust gas post-processing device 200 by way of welding and the lower end can be coupled with the flange coupling portion 211 of the exhaust gas inlet. 210 by way of welding.

Meanwhile, the fixing means 300 further includes the brace 360 disposed between the flange pipe 160 and the exhaust manifold 140 in order to support the weight of the exhaust gas post-processing device 200. Accordingly, the fitting structure of the exhaust gas post-processing device 200 can be enhanced.

Here, the upper end of the brace 360 can be coupled with the bottom of the flange pipe 160 by way of welding or can be formed integrally with the flange pipe 160 using a method, such as casting. The lower end of the brace 360 can be coupled with the to of the exhaust manifold 140 using bolts.

Furthermore, if a heat-shielding plate 141 for shielding heat emitted from the exhaust manifold 140 is installed, the heat-shielding plate 141 is interposed between the coupling surfaces of the exhaust manifold 140 and of the brace 360. When the lower end of the brace 360 is coupled with the top of the exhaust manifold 140 using bolts, if necessary, the heat-shielding plate 141 can be fixed along with the brace 360.

In the present invention having the above construction, an exhaust gas resulting from the driving of the engine 120 is discharged toward the exhaust manifold 140. In the case of a surcharging type, the exhaust gas flows into the turbo charger 150 installed on the exhaust manifold (140) side and thus drives the turbine. Next, the exhaust gas is supplied to the exhaust gas inlet 210 of the exhaust gas post-processing device 200 through the flange pipe 160.

The exhaust gas supplied to the exhaust gas post-processing device 200 through the exhaust gas inlet 210 is purified through a diesel oxidation catalyst and a diesel particulate filter and is then discharged into the air through the purification gas outlet 220. Here, the purification gas outlet 220 may be coupled with the muffler pipe installed outside the engine room 100.

In accordance with an embodiment of the present invention described above, the exhaust gas post-processing device is disposed in parallel to the length direction of the engine over the exhaust manifold of the engine, and the exhaust gas inlet is directly coupled with the exhaust manifold or the turbo charger disposed under the exhaust gas inlet through the flange pipe so that the distance between the exhaust gas outlet of the engine and the exhaust gas inlet of the exhaust as post-processing device is reduced to the shortest distance. Accordingly, energy efficiency can be improved, and the exhaust as post-processing device can have improved purification performance.

Furthermore, in the present invention, the sag and vibration impact of the exhaust gas post-processing device can be stably supported by installing the fixing means for supporting the weight of the exhaust gas post-processing device between the engine and the exhaust gas post-processing device. Accordingly, there is an advantage in that the lifespan and purification performance of the exhaust gas post-processing device can be maintained stably.

Furthermore, the present invention is advantageous in that an influence on the engine can be minimized and an economic effect is achieved by proposing the structure including additional brackets for support without processing an engine casing or changing an existing engine room structure in installing fixing means.

INDUSTRIAL APPLICABILITY

The present invention can be used as a fitting structure for strongly supporting the exhaust gas post-processing device of a diesel engine that is mounted on an agricultural task vehicle.

The invention claimed is:

1. A fitting structure for fitting an exhaust gas post-processing device (200) for purifying an exhaust as from an engine (120) of an agricultural task vehicle into an engine room (100) in an agricultural task vehicle, wherein:

the exhaust gas post-processing device (200) is disposed in parallel to a length direction of the engine (120) over an exhaust manifold (140) of the engine (120), an exhaust gas inlet (210) is coupled with the exhaust manifold (140) or a turbo charger (150) disposed under the exhaust gas inlet (210) through a flange pipe (160), and fixing means (300) for supporting a weight of the exhaust gas post-processing device (200) is installed between the engine (120) and the exhaust gas post-processing device (200); and the fixing means (300) comprises a front bracket installed between a cylinder head (121) on a front side of the engine (120) and a DPF canning (240) of the exhaust gas post-processing device (200) and a rear bracket installed between the cylinder head (121) on a rear side of the engine (120) and a flange coupling portion (161) of the flange pipe (160).

2. The fitting structure of claim 1, wherein the exhaust gas post-processing device (200) is disposed in an upper left part of the engine (120) when a flywheel housing (130) of the engine (120) is seen at a front.

3. The fitting structure of claim 1, wherein the exhaust gas post-processing device (200) comprises the exhaust gas inlet (210) formed in a rear of the engine (120) and a purification gas outlet (220) formed in front of the engine (120).

4. The fitting structure of claim 3, wherein the purification gas outlet (220) of the exhaust gas post-processing device (200) is disposed toward a bottom of the engine room (100).

5. The fitting structure of claim 1, wherein:

the flange pipe (160) is curved in a curved pipe form in which pipes extended in a horizontal direction and a vertical direction are coupled, a flange coupling portion coupled with the exhaust manifold (140) or a turbo charger (150) is formed at an end of the pipe in the horizontal direction, and another flange coupling portion coupled with the exhaust gas inlet (210) is formed at an end of the pipe in the vertical direction.

6. The fitting structure of claim 1, wherein the front bracket comprises:

a first bracket (310) having a lower end coupled with the cylinder head (121) on the front side of the engine (120); and a second bracket (320) installed between an upper end of the first bracket (310) and a bottom of the DPF canning (240) of the exhaust gas post-processing device (200) in such a way as to support the weight of the exhaust as post-processing device (200).

7. The fitting structure of claim 6, wherein the lower end of the it bracket (310) is coupled with a side of the cylinder head (121) and the upper end of the first bracket (310) is detachably coupled with the second bracket (320) in such a way as to form a bolt coupling portion (B1).

8. The fitting structure of claim 7, wherein the second bracket (320) has an upper end coupled with the bottom of the DPF canning (240) of the exhaust as post-processing device (200) by way of welding and has a lower end detachably coupled with the upper end of the first bracket (310) using the bolt coupling portion (B1).

9. The fitting structure of claim 6, wherein the first bracket (310) has the lower end coupled with a side of the cylinder head (121) through a long hole so that a position of the first bracket (310) is adjusted and has the upper end coupled with the second bracket (320) by way of welding or formed integrally with the second bracket (320).

10. The fitting structure of claim 9, wherein planes of the first bracket (310) and the second bracket (320) are coupled in such a way as to cross each other.

11. The fitting structure of claim 1, wherein the rear bracket comprises:

a third bracket (340) having a lower end coupled with the cylinder head (121) on the rear side of the engine (120) and having an upper end coupled with the flange coupling portion (161) of the flange pipe (160) coupled with the exhaust gas inlet (210); and a fourth bracket (350) having lower end coupled with a flange coupling portion (211) of the exhaust gas inlet (210) coupled with the flange pipe (160) and having an upper end coupled with a bottom of a DOC canning (230) of the exhaust gas post-processing device (200) in such as a way as to support the weight of the exhaust gas post-processing device (200).

12. The fitting structure of claim 11, wherein the third bracket (340) has the lower end extended in a horizontal direction and detachably coupled with a top of the cylinder head (121) using bolts and has the upper end, extended in a vertical direction, coupled with a side of the flange coupling portion (161) of the flange pipe (160) using bolts or welding.

13. The fitting structure of claim 11, wherein the fourth bracket (350) has the lower end and the upper end curved and extended in a horizontal direction, has the upper end coupled with the bottom of the DOC canning (230) of the exhaust gas post-processing device (200) by way of welding, and has the lower end coupled with the flange coupling portion (211) of the exhaust gas inlet (210) by way of welding.

14. The fitting structure of claim 1, wherein the fixing means (300) further comprises a brace (360) disposed between the flange pipe (160) and the exhaust manifold (140), for supporting the weight of the exhaust gas post-processing device (200).

15. The fitting structure of claim 14, wherein:

an upper end of the brace (360) is coupled with a bottom of the flange pipe (160) by way of welding or formed integrally with the flange pipe (160), and a lower end of the brace (360) is coupled with a top of the exhaust manifold (140) using bolts.

16. The fitting structure of claim 15, wherein a heat-shielding plate (141) is interposed between coupling surfaces of the exhaust manifold (140) and the brace (360).

* * * * *